US005680843A

United States Patent [19]

Bacon, Jr. et al.

[11] Patent Number: 5,680,843

[45] Date of Patent: Oct. 28, 1997

[54] METHOD OF REPLICATING A CRANKSHAFT POSITION SIGNAL

[75] Inventors: Edwin W. Bacon, Jr., Goodrich; Robert P. Carson, Oxford, both of Mich.

[73] Assignee: Chrysler Corporation, Auburn Hills, Mich.

[21] Appl. No.: 761,271

[22] Filed: Dec. 6, 1996

[51] Int. Cl.[6] ..... F02P 5/145

[52] U.S. Cl. ..... 123/414; 123/630

[58] Field of Search ..... 123/414, 476, 123/479, 477, 612, 613, 630

[56] References Cited

U.S. PATENT DOCUMENTS

| | | | |
|---|---|---|---|
| 4,615,318 | 10/1986 | Imoto et al. | 123/414 |
| 4,953,531 | 9/1990 | Abe | 123/414 |
| 5,099,811 | 3/1992 | Frantz et al. | 123/416 |
| 5,267,544 | 12/1993 | Ohkumo et al. | 123/414 |
| 5,345,909 | 9/1994 | Fukui et al. | 123/414 |
| 5,584,274 | 12/1996 | Fukui et al. | 123/414 |

*Primary Examiner*—Willis R. Wolfe
*Assistant Examiner*—Hieu T. Vo
*Attorney, Agent, or Firm*—Mark P. Calcaterra

[57] ABSTRACT

A method of replicating a crankshaft position signal for an internal combustion engine in a motor vehicle includes the steps of determining whether at least one predetermined condition is met and ending the method if the at least one predetermined condition is not met. The method also includes the steps of determining which cylinder is firing if the at least one predetermined condition is met and determining an ignition period between cylinder firing events for the cylinder that is firing. The method further includes the steps of determining a time to synthesize a crankshaft edge based on the ignition period. The method also includes the step of synthesizing a crankshaft edge based on the time and operating the internal combustion engine based on the synthesized crankshaft edge.

12 Claims, 2 Drawing Sheets

METHOD OF REPLICATING A CRANKSHAFT POSITION SIGNAL

BACKGROUND OF THE INVENTION

1. Field of the Invention

The present invention relates generally to internal combustion engines and, more particularly, to a method of replicating a crankshaft position signal for an internal combustion engine in a motor vehicle.

2. Description of the Related Art

An internal combustion engine in a motor vehicle includes a camshaft that is mechanically linked to a crankshaft. The relative position of the camshaft and crankshaft is obtained through a sensing mechanism, such as a camshaft position sensor and crankshaft position sensor, respectively. The signal from the crankshaft position sensor and the camshaft position sensor is transmitted to a mechanism for controlling engine functions, such as an engine controller. For example, the engine controller utilizes the signal from the crankshaft position sensor to control operations dependent on crankshaft position, such as firing the spark in the engine.

If for any reason the signal from the crankshaft position sensor is unavailable, the crankshaft position sensor signal dependent operations may be affected. One example is that the engine may not run. Thus, there is a need in the art for a method of replicating the signal from the crankshaft position sensor, if the crankshaft position sensor signal is unavailable, to maintain crankshaft position sensor dependent operations.

SUMMARY OF THE INVENTION

It is, therefore, one object of the present invention to provide a method of replicating a crankshaft position signal for an internal combustion engine in a motor vehicle.

It is another object of the present invention to provide a method of replicating a signal from a crankshaft position sensor to maintain crankshaft position sensor dependent operations for an internal combustion engine in a motor vehicle.

It is yet another object of the present invention to maintain motor vehicle operation when a crankshaft position sensor signal is unavailable for an internal combustion engine in a motor vehicle.

It is still another object of the present invention to provide a method of synthesizing a crankshaft position sensor signal using a camshaft position sensor signal for an internal combustion engine in a motor vehicle.

To achieve the foregoing objects, the present invention is a method of replicating a crankshaft position signal for an internal combustion engine in a motor vehicle. The method includes the steps of determining whether at least one predetermined condition is met, and ending the method if the at least one predetermined condition is not met. The method also includes the step of determining which cylinder is firing if the at least one predetermined condition is met. The method also includes the step of determining an ignition period between cylinder firing events for the cylinder that is firing. The method further includes the step of determining a time to synthesize a crankshaft edge based on the ignition period. The method further includes the step of synthesizing a crankshaft edge based on the time and operating the internal combustion engine based on the synthesized crankshaft edge.

One advantage of the present invention is that a method of replicating a crankshaft position signal is provided, allowing for continued motor vehicle operation when the crankshaft position sensor signal is unavailable. Another advantage of the present invention is that the method allows motor vehicle operation to continue uninterrupted if the crankshaft position sensor signal is unavailable. Yet another advantage of the present invention is that the method replicates the crankshaft position signal from the camshaft position sensor. Still another advantage of the present invention is that the method takes advantage of the relationship between the camshaft and crankshaft by using the signal from the camshaft position sensor to synthesize the crankshaft position sensor signal.

Other objects, features and advantages of the present invention will be readily appreciated as the same becomes better understood after reading the subsequent description taken in conjunction with the accompanying drawings.

BRIEF DESCRIPTION OF THE DRAWINGS

FIGS. 2A and 3B are flowcharts of a method of replicating a crankshaft position signal, according to the present invention, for the engine control system of FIG. 1.

DESCRIPTION OF THE PREFERRED EMBODIMENT(S)

Figure 1:
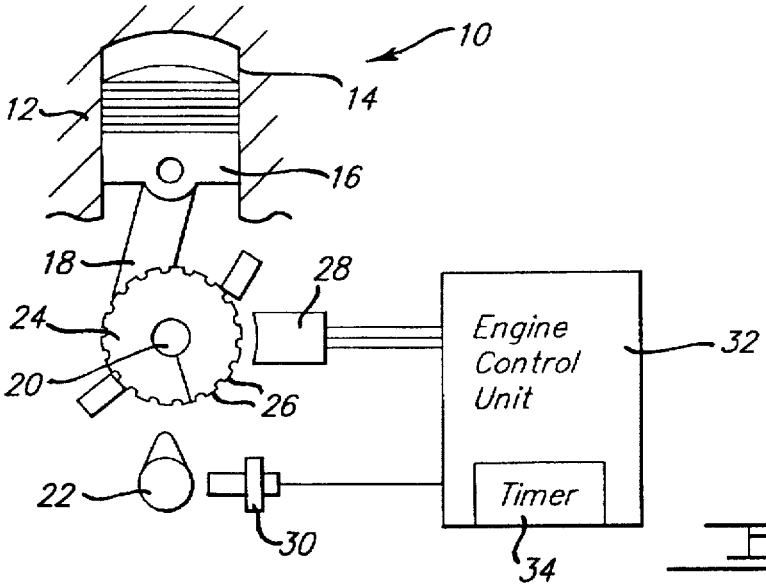
FIG. 1 is a schematic diagram of an engine control system for executing a method, according to the present invention, for an internal combustion engine.

Referring to FIG. 1, an engine control system 10 used in conjunction with a method, according to the present invention, is illustrated schematically for an internal combustion engine 12. The engine 12 is partially shown in a cut-away view, illustrating one of a multiple of cylinders 14 in the engine 12. The engine 12 includes a piston 16 disposed within each cylinder 14. The piston 16 is operatively connected by a connecting rod 18 to a crankshaft 20. A camshaft 22 is used to open and close at least two valves (not shown) of the cylinder 14 for various strokes of the piston 16. In a four stroke spark-ignited (SI) engine these strokes include intake, compression, expansion and exhaust.

The engine control system 10 includes a crankshaft sensor target 24 operatively connected to the crankshaft 20 and including at least one, preferably a plurality of trip points 26. The engine control system 10 also includes a crankshaft position sensing mechanism or sensor 28 in communication with the crankshaft sensor target 24 and a camshaft position sensing mechanism or sensor 30 in communication with the camshaft 22. It should be appreciated that the crankshaft 20 and camshaft 22 are mechanically linked together.

The engine control system 10 further includes an electronic controller such as an engine controller 32 in communication with sensors 28 and 30. The engine controller 32 includes a time keeping mechanism or timer 34. It should be appreciated that the engine controller 32 utilizes outputs of sensors 28 and 30 to determine the radial position of the piston 16 within a cylinder 14, generally measured in degrees. It should further be appreciated that the output from the crankshaft position sensor 28 may be used to determine a speed of the engine 12, typically measured in revolutions per minute (RPM).

A spark plug (not shown) is operably connected to an individual cylinder 14, and the firing of the spark plug initiates the burn charge in the cylinder 14. It should be appreciated that the engine controller 32 signals the spark plug to fire at a designated spark advance. The spark advance is quantified as the number of crankshaft angle degrees before top-dead-center on the compression stroke. The combination of spark advance, fuel and air determine the burn rate for the charge in the cylinder. Therefore, adjusting the spark advance modifies the burn charge.

Preferably, the engine 12 also includes various other sensing mechanisms or sensors to carry out its functions, such as a throttle position sensor (not shown) or a Manifold Absolute Pressure (MAP) sensor (not shown), which are conventional and well known in the art. The outputs of these sensors also communicate with the engine controller 32. It should be appreciated that the engine control system 10 also includes other hardware not shown but conventional in the art to carry out the method to be described.

Figure 2A:
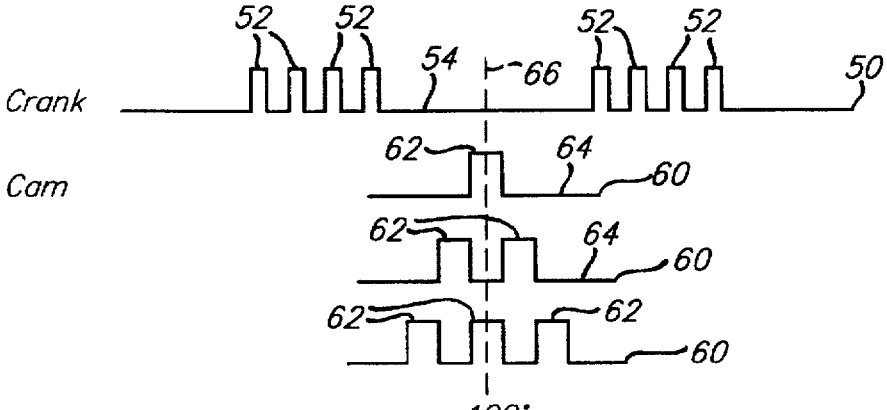
Prior Art FIG. 2A.
FIG. 2A is a schematic diagram illustrating a prior art relationship between a typical crankshaft position sensor signal and camshaft position sensor signal.

Referring to FIG. 2A, a prior art relationship between a typical crankshaft position sensor signal 50 and a camshaft position sensor signal 60 for the internal combustion engine 12 is illustrated schematically. It should be appreciated that the internal combustion engine 12 is a six cylinder engine, by way of example.

The signal 50 from the crankshaft position sensor 28 is typically a square wave and characterized by a unique pattern of pulses 52. The interval between a selected edge and each pattern of pulses 52 is an ignition period 54. The signal 60 from the camshaft position sensor 30 is also typically a square wave and characterized by a unique pattern of pulses 62. The ignition period 64 is the interval between each pattern of pulses 62. Each pattern of camshaft pulses 62 tends to mirror about a common axis 66, such as one hundred twenty (120) degrees in this example.

Figure 2B:
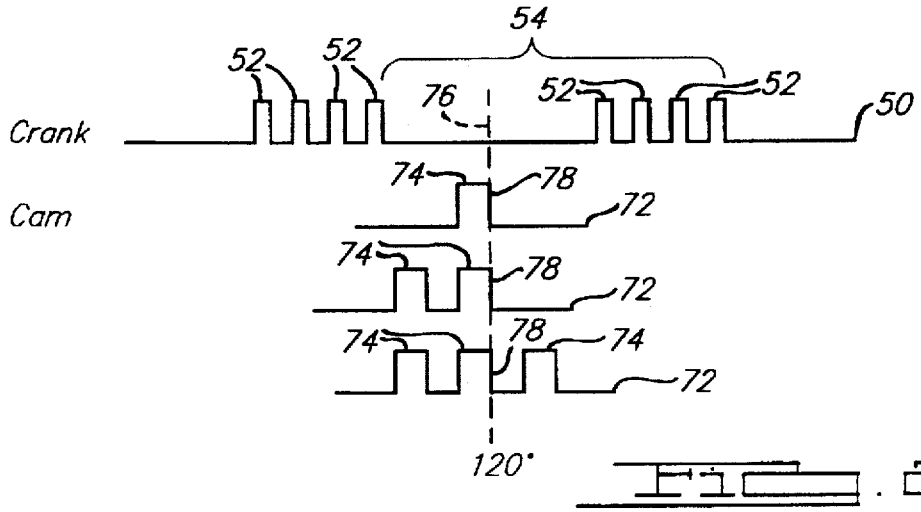
FIG. 2B is a schematic diagram illustrating a relationship between a crankshaft position sensor signal and a skewed camshaft position sensor signal, according to the present invention.

Referring to FIG. 2B, a relationship between a typical crankshaft position sensor signal 50 and a skewed camshaft position sensor signal 72 is schematically illustrated. Each pattern of camshaft pulses 74 is separated as in FIG. 2A and repositioned with respect to a common axis 76, such as 120 degrees. A trailing edge 78 of each skewed camshaft pulse 74 is now exactly one hundred twenty (120) degrees apart. Once the pattern of skewed camshaft pulses 74 is identified, the trailing or camshaft signal reference edge 78 is identifiable so that a new crankshaft position signal can be synthesized.

Figure 3A:
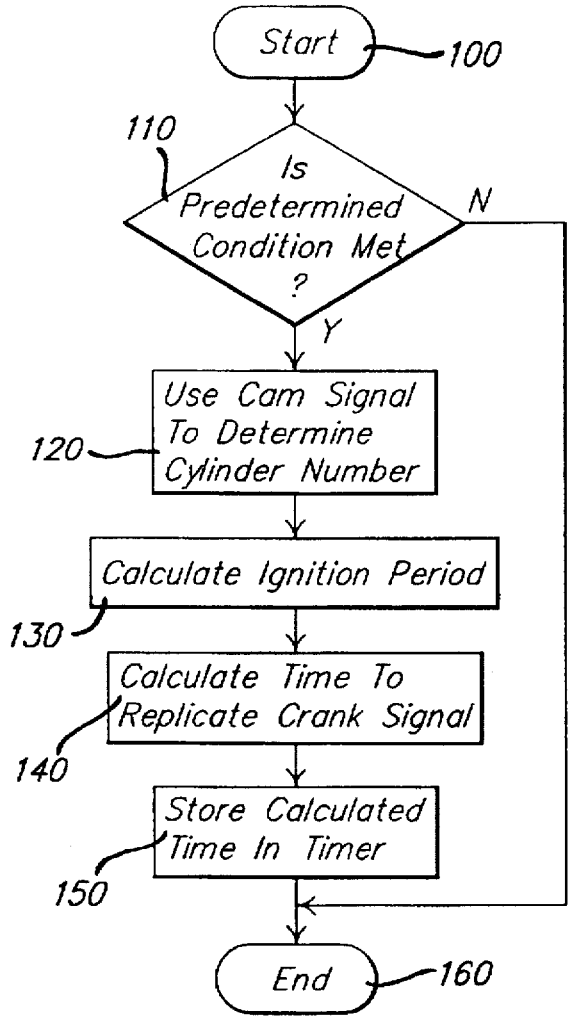
Figure 3B:
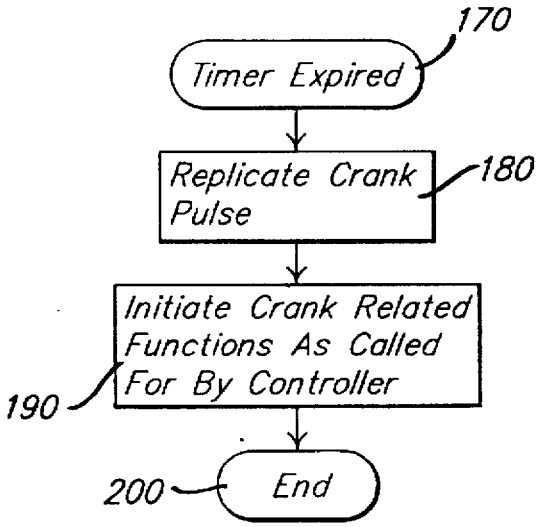

Referring to FIGS. 3A and 3B, a flowchart of a method of replicating the crankshaft position signal, according to the present invention, is illustrated. In FIG. 3A, the methodology begins in bubble 100, when it is called for from a cam pulse service program stored in the engine controller 32. The methodology advances to diamond 110 and determines whether at least one predetermined condition is met. An example of a predetermined condition is whether the crankshaft position sensor signal 50 is not received by the engine controller 32. If the predetermined condition is not met, the methodology advances to bubble 160 and ends the routine.

If the predetermined condition is met, the methodology advances to block 120 and determines which cylinder 14 is firing. For example, the method determines which cylinder 14 is firing by recognizing the pattern of camshaft pulses 74. The method recognizes the pattern of camshaft pulses 74 by measuring a pulse width of the camshaft pulse 74 and the period between camshaft pulses 74. The method divides the period by the pulse width for the camshaft pulses 74 to obtain a camshaft reference ratio. The method then evaluates the camshaft reference ratio to recognize the pattern of camshaft pulses 74. For example, if the camshaft reference ratio is large, such as greater than five (5), the camshaft signal 72 is in a new camshaft pulse pattern 74. If not, the camshaft signal 72 is in the middle of a pattern of camshaft pulses 74. The method then compares the recognized pattern of camshaft pulses 74 to a predetermined pattern of camshaft pulses, such as that contained in a look-up table stored in memory of the engine controller 32, to determine which cylinder 14 is firing.

After block 120, the methodology advances to block 130 and calculates an ignition period. At the falling or trailing edge 78 of the camshaft pulse 74, the method determines an ignition period, such as by calculating a time between the current trailing edge 78 and a trailing edge 78 in a previous pattern of camshaft pulses 74. In this example, the trailing edges 78 are one hundred twenty (120) degrees apart. After block 130, the methodology advances to block 140 and determines the time to replicate or synthesize a first crankshaft edge by calculating the difference between the time of the trailing edge 78 and the time for the edge where the crankshaft position signal should occur. After block 140, the methodology advances to block 150 and stores the calculated time to synthesize the first crankshaft edge in the timer 34. After block 150, the methodology advances to bubble 160 and ends the routine.

In FIG. 3B, the methodology advances to bubble 170 when the timer 34 counts to expiration. The methodology then advances to block 180 and synthesizes or replicates the crankshaft signal pulse 52. It should be appreciated that subsequent crankshaft edges can be synthesized after the first crankshaft edge is known to obtain the crankshaft position signal.

In block 180, the crankshaft signal pulse 52 is determined for the cylinder 14 that is firing. The methodology then advances to block 190 and operates the internal combustion engine 14 by initiating crankshaft related activities or functions for the individual cylinder 14 as called for by the engine controller 32. The methodology then advances to bubble 200 and returns to a main engine control program stored in the engine controller 32.

The present invention has been described in an illustrative manner. It is understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of replicating a crankshaft position signal for an internal combustion engine in a motor vehicle, said method comprising the steps of:

determining whether at least one predetermined condition is met;

ending the method if the at least one predetermined condition is not met;

determining which cylinder is firing if the at least one predetermined condition is met;

determining an ignition period between cylinder firing events for the cylinder that is firing;

determining a time to synthesize a crankshaft edge based on the ignition period;

synthesizing the crankshaft edge based on the time; and operating the internal combustion engine based on the synthesized crankshaft edge.

2. A method as set forth in claim 1 wherein said step of determining whether a predetermined condition is met includes determining whether a signal from a crankshaft position sensing mechanism is unavailable.

3. A method as set forth in claim 1 wherein said step of determining which cylinder is firing includes recognizing a camshaft pulse pattern from a camshaft position sensing mechanism signal.

4. A method as set forth in claim 3 wherein said step of recognizing a camshaft pulse pattern comprising:

measuring a camshaft pulse width from the camshaft position sensing mechanism signal;

measuring a camshaft pulse period from the camshaft position sensing mechanism signal;

calculating a camshaft reference ratio by dividing said camshaft pulse period by said camshaft pulse width;

recognizing the camshaft pulse pattern by comparing said camshaft reference ratio to a predetermined camshaft pulse pattern; and comparing said recognized camshaft signal pulse pattern to a predetermined camshaft pulse pattern for an individual cylinder.

5. A method as set forth in claim 1 wherein said step of determining the ignition period includes calculating a time between a current camshaft position sensing mechanism signal reference edge and a previous camshaft position sensing mechanism signal reference edge.

6. A method as set forth in claim 1 wherein the time to synthesize the crankshaft edge is the difference between the time of a camshaft position sensing mechanism signal reference edge and a time when the crankshaft edge should occur.

7. A method as set forth in claim 1 wherein a countdown timer counts down the time to synthesize the crankshaft edge.

8. A method of replicating a crankshaft position signal for an internal combustion engine in a motor vehicle, said method comprising the steps of:

determining whether a predetermined condition is met;

ending the method if the predetermined condition is not met;

determining which cylinder is firing by recognizing a camshaft signal pulse pattern from a camshaft position sensing mechanism if the predetermined condition is met;

determining an ignition period based on which cylinder is firing;

determining a time to synthesize a crankshaft edge by taking the difference between a time of a camshaft position sensing mechanism reference edge and a time when the crankshaft edge should occur;

counting down to zero from the time to synthesize the crankshaft edge; and synthesizing the crankshaft edge and operating the internal combustion engine based on the synthesized crankshaft edge.

9. A method as set forth in claim 8 wherein said step of determining whether a predetermined condition is met includes determining whether a signal from a crankshaft position sensing mechanism is unavailable.

10. A method as set forth in claim 8 wherein said step of recognizing the camshaft signal pulse pattern comprises:

measuring a camshaft pulse width from the camshaft position sensing mechanism signal;

measuring a pulse period from the camshaft position sensing mechanism signal;

calculating a camshaft reference ratio by dividing the camshaft pulse period by the camshaft pulse width;

recognizing the camshaft pulse pattern by comparing the camshaft reference ratio to a predetermined camshaft pulse pattern; and comparing the recognized camshaft signal pulse pattern to a predetermined individual cylinder camshaft pulse pattern.

11. A method as set forth in claim 8 wherein said step of determining the ignition period includes calculating a time between a current camshaft position sensing mechanism reference edge and a previous camshaft position sensing mechanism reference edge.

12. A method as set forth in claim 8 wherein a countdown timer counts down the time to synthesize a crankshaft edge.

* * * * *